US012606341B1

(12) United States Patent
Bamberg

(10) Patent No.: US 12,606,341 B1
(45) Date of Patent: Apr. 21, 2026

(54) JAR PACKAGING FOR PILLOWCASE

(71) Applicant: Melissa Bamberg, Loomis, CA (US)

(72) Inventor: Melissa Bamberg, Loomis, CA (US)

( * ) Notice: Subject to any disclaimer, the term of this patent is extended or adjusted under 35 U.S.C. 154(b) by 0 days.

(21) Appl. No.: 18/739,892

(22) Filed: Jun. 11, 2024

(51) Int. Cl.

| | |
|---|---|
| ***B65D 1/10*** | (2006.01) |
| ***A47G 9/00*** | (2006.01) |
| ***A47G 9/02*** | (2006.01) |
| ***B65D 43/02*** | (2006.01) |
| ***B65D 85/07*** | (2017.01) |

(52) U.S. Cl.
CPC ..... *B65D 1/10* (2013.01); *A47G 9/007* (2013.01); *A47G 9/0253* (2013.01); *B65D 43/0231* (2013.01); *B65D 85/07* (2018.01); *B65D 2401/10* (2020.05)

(58) Field of Classification Search
CPC ..... A47G 9/007; A47G 9/0253
USPC ..... 215/400; 206/223, 541, 568, 569, 570, 206/573, 574, 575, 576, 577, 578, 579, 206/580, 581, 582, 224, 225, 227, 228, 206/229, 231
See application file for complete search history.

(56) References Cited

U.S. PATENT DOCUMENTS 1,430,690 A * 10/1922 Schwab ..... B65D 5/14 206/407
1,879,410 A * 9/1932 Morris ..... B65D 25/16 141/390
3,437,197 A * 4/1969 Wirfel ..... B65D 85/07 206/83.5
3,746,158 A * 7/1973 Connick ..... B65D 81/3205 206/568
3,842,977 A * 10/1974 Hollander ..... A45C 3/00 206/407
4,480,346 A * 11/1984 Hawkins ..... A47G 9/0253 5/490
4,761,872 A * 8/1988 Buettner ..... B23P 19/04 5/636
4,778,069 A * 10/1988 Keller ..... B65D 55/066 215/250
4,852,739 A * 8/1989 Franco ..... G11B 23/0233 206/387.1
5,076,424 A * 12/1991 Nakamura ..... A47K 10/421 206/409
5,240,131 A * 8/1993 Keller ..... B65D 79/0087 215/276
5,457,829 A * 10/1995 Elliott ..... A47G 9/0207 5/490
6,328,158 B1 * 12/2001 Bisbal ..... A45C 3/00 383/106

(Continued)

OTHER PUBLICATIONS

COPPRY;Copper-Infused Mulberry Silk Pillowcase; www.coppry.com; 2021.

*Primary Examiner* — Steven A. Reynolds
*Assistant Examiner* — Prince Pal
(74) *Attorney, Agent, or Firm* — Heisler & Associates

(57) ABSTRACT

A pillowcase is contained within a jar. The jar has an at least partly transparent sidewall. The pillowcase can thus be viewed through the sidewall of the jar. The sidewall is cylindrical in one embodiment, extending up from a circular base, which base is also at least partially transparent. A lid selectively closes an opening into an interior of the jar. The pillowcase has panels, folds and edges, which can be seen through the at least partly transparent sidewall of the jar and the base. The pillowcase in one embodiment is made of silk fabric and/or is infused with copper ions.

3 Claims, 4 Drawing Sheets

(56) References Cited

U.S. PATENT DOCUMENTS 6,427,268 B1 * 8/2002 Davis ..... A47G 9/0253 5/490
7,322,057 B2 * 1/2008 Merlini ..... A47G 9/1045 5/639
8,127,382 B1 * 3/2012 Plascencia ..... A47G 9/1045 5/639
8,443,974 B2 * 5/2013 Oh ..... B65B 25/146 206/394
8,898,834 B1 * 12/2014 Huber ..... A47C 31/105 5/482
8,905,412 B2 * 12/2014 Fux ..... B62B 1/18 280/47.26
10,426,279 B2 * 10/2019 Ibrahim ..... A61G 7/07
11,141,009 B1 * 10/2021 Rane ..... A47G 9/10
11,801,975 B1 * 10/2023 DeCosmo, Jr. ..... B65B 67/1238
2002/0148742 A1 * 10/2002 Bisbal ..... A45C 3/00 206/223
2003/0002755 A1 * 1/2003 Kim ..... B65D 33/004 229/117.27
2003/0135926 A1 * 7/2003 Ong ..... A47G 9/083 5/639
2006/0174411 A1 * 8/2006 Merlini ..... A47G 9/1045 5/490
2007/0044239 A1 * 3/2007 Leifermann ..... A47G 9/1081 5/636
2007/0161490 A1 * 7/2007 Srivastava ..... A47G 9/0253 493/464
2007/0245490 A1 * 10/2007 Oh ..... A47F 5/0018 5/413 R
2009/0144901 A1 * 6/2009 Zorger ..... A47G 9/0253 5/489
2010/0002962 A1 * 1/2010 Tatsuno ..... A47G 9/086 383/85
2010/0043145 A1 * 2/2010 McCollum ..... A47G 9/0238 5/490
2010/0059410 A1 * 3/2010 Smith ..... B65D 85/182 206/774
2010/0059531 A1 * 3/2010 Smith ..... B65D 5/46016 220/666
2010/0139002 A1 * 6/2010 Walker ..... A47G 9/0253 5/636
2011/0064332 A1 * 3/2011 Piazza ..... B65D 81/2023 383/44
2011/0094905 A1 * 4/2011 Piazza ..... B65D 81/2023 53/434
2011/0293205 A1 * 12/2011 Piazza ..... B65D 81/2023 206/524.8
2012/0267281 A1 * 10/2012 Fux ..... B65D 33/02 53/436
2014/0053336 A1 * 2/2014 Cai ..... A47G 9/10 5/636
2014/0076889 A1 * 3/2014 Stolzman ..... B31B 50/62 220/613
2014/0196214 A1 * 7/2014 DuPre ..... A47G 9/1081 5/636
2014/0208693 A1 * 7/2014 Fux ..... B65D 75/566 53/436
2015/0251843 A1 * 9/2015 Fux ..... B65D 43/0235 206/386
2016/0052702 A1 * 2/2016 Lawrie ..... B65D 85/07 53/430
2016/0304231 A1 * 10/2016 Corodemus ..... B65B 5/045
2017/0020312 A1 * 1/2017 Davis ..... A47G 9/10
2017/0072056 A1 * 3/2017 Egberg ..... A61K 47/22
2017/0225862 A1 * 8/2017 Schnabel ..... B65D 5/103
2018/0263389 A1 * 9/2018 Lee ..... A47G 9/0223
2019/0168956 A1 * 6/2019 Fux ..... B65D 85/07
2019/0343305 A1 * 11/2019 Cubbler ..... A47G 9/0253
2020/0405023 A1 * 12/2020 Cook ..... A45C 3/001
2021/0086958 A1 * 3/2021 Tobias ..... B65D 81/3865
2022/0031100 A1 * 2/2022 Peets ..... A47G 9/0253
2022/0061552 A1 * 3/2022 Savary ..... A47G 9/1081
2022/0228300 A1 * 7/2022 Inoue ..... A61L 9/16
2023/0065939 A1 * 3/2023 Zambrotta ..... B44D 3/123
2023/0192361 A1 * 6/2023 Gordon ..... B65D 41/0442 215/337
2024/0034024 A1 * 2/2024 Manuszak ..... B32B 3/04
2024/0239561 A1 * 7/2024 Orlando ..... B65D 25/56
2025/0066077 A1 * 2/2025 Rosenberg ..... B65D 23/0885
2025/0083866 A1 * 3/2025 Miller ..... B65D 1/10
2025/0113934 A1 * 4/2025 Darby ..... A47G 9/0253
2025/0134282 A1 * 5/2025 Luttrell ..... A47G 9/0261
2025/0143491 A1 * 5/2025 Bausby-Tanner .... A47G 9/0246

* cited by examiner

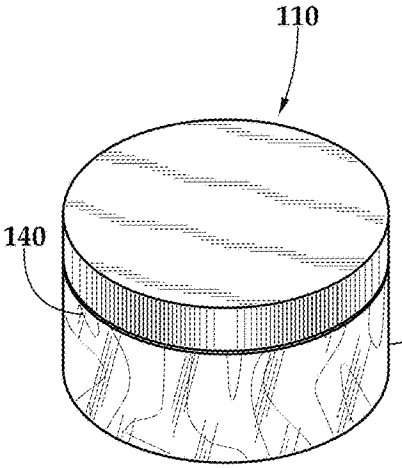
Fig.9
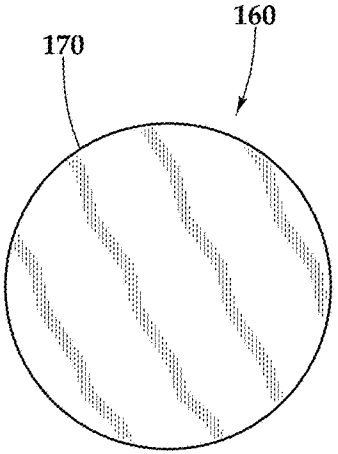
Fig.14
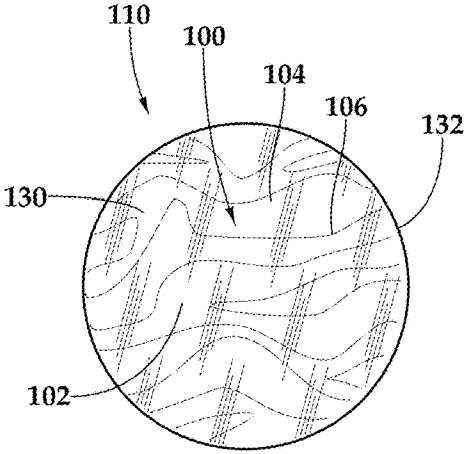
Fig.15
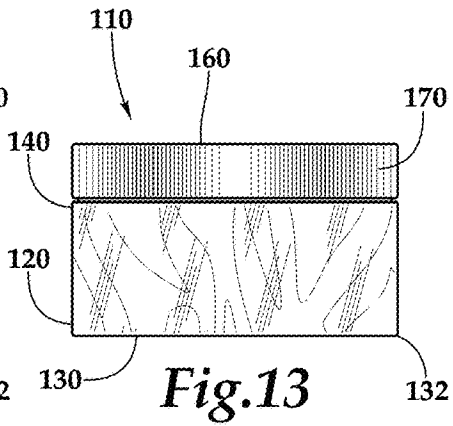
Fig.10
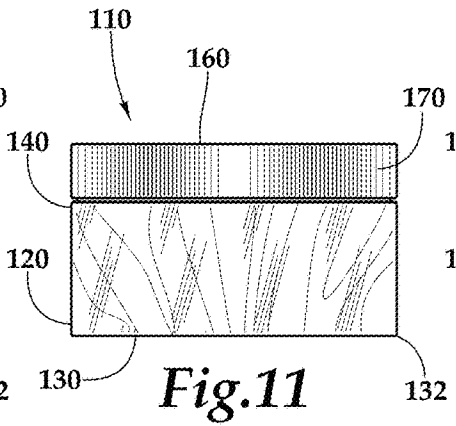
Fig.11
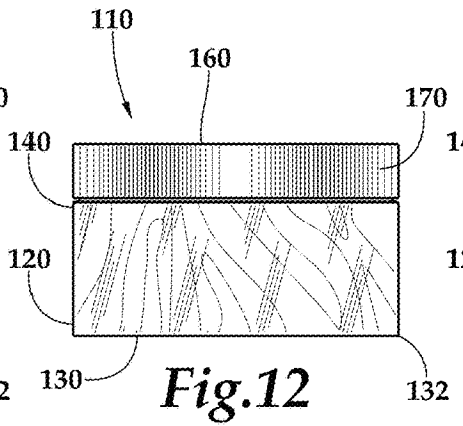
Fig.12
Fig.13

JAR PACKAGING FOR PILLOWCASE

FIELD OF THE INVENTION

The following invention relates to packaging for pillowcases. More particularly, this invention relates to jars with pillowcases therein.

BACKGROUND OF THE INVENTION

Pillowcases are known in the prior art for containing a pillow therein. Typically a pillowcase has a front and rear panel defining opposite sides of the pillowcase. Perimeters of these two panels are sewn together on three of four sides, leaving a fourth side open for insertion and removal of a pillow. Typically, pillowcases are rectangular in form with one of the short sides being open.

Pillowcases are most commonly made of flexible fabric. While cotton is perhaps the most common fabric from which pillowcases are made, many individuals enjoy having a silk pillowcase. Silk is a natural protein fiber, some forms of which can be woven into textiles. The protein fiber of silk is composed mainly of fibroin and is produced by certain insect larvae to form cocoons. The best known silk is obtained from the cocoons of the larvae of the mulberry silk worm, *Bombyx mori*, reared in captivity. Silk is exceptionally soft and smooth, typically being cool to the touch. When silk fabric is used for construction of a pillowcase, the unique attributes of silk are provided for the head and face and neck of an individual.

Beneficial attributes of silk for a pillowcase include benefits for hair and skin. For hair, the smooth silk helps to keep hair smooth and to avoid tangles and breakage. For skin, the smooth silk fabric is the opposite of abrasive, preserving fine skin texture, especially on the face and neck. Silk fabric is also cool to the touch, inhibiting perspiration. The softness of silk also has mental health benefits when in a pillowcase, including imparting calmness, comfort and health self-concept.

Fabrics can be treated in various different ways to alter their characteristics. One form of fabric treatment is to infuse the fabric with copper ions. Copper ion infused fabrics have been shown to exhibit antibacterial and related beneficial sanitary characteristics. Because copper is highly electrically conductive, infusion of fabric, and especially pillowcase fabric with copper ions, can provide electrical and electromagnetic benefits to the head and neck.

In particular, modern life involves exposure to large amounts of electromagnetic radiation. This radiation can be caused by smart phones and other cordless phones, Wi-Fi routers, mobile telecommunications "cell" towers, as well as natural terrestrial and cosmic sources of radiation. To provide some shielding from these sources of radiation, especially while sleeping, a copper ion infused fabric pillowcase can act as a partial shield to reduce radiation exposure, especially to the brain. Even small reductions, when multiplied by the large amount of time spent sleeping, causes such use of a copper ion infused fabric pillowcase to provide significant benefits.

Silk fabric and copper ion infused fabric each have unique appearance. Silk fabric has the appearance of a very fine woven fabric, and also is somewhat glossy and reflective in appearance, more so than cotton and other fabrics. Copper ion infused fabric has a somewhat copper-like color. Pillowcases are typically merchandised in a clear plastic envelope. The clear plastic envelope allows a shopper to see the color and other appearance attributes of the pillowcase, and keeps (or limits) shoppers from touching the fabric itself.

Plastic envelopes are not entirely desirable as a pillowcase packaging. Because the plastic is flexible, and because the pillowcase is also flexible, the package is floppy and generally does not hold a smooth, regular shape, such as a flat or cylindrical shape. Light reflects and refracts a variety of different ways through the flexible plastic package. Depending on lighting conditions, it can be difficult to see the fabric well through the plastic. Furthermore, plastic, although useful, also has undesirable characteristics, such as a tendency for small amounts of plastic packaging to remain as residue upon items contained within the plastic packaging. Also, typical plastic packaging for pillowcases is not sealed, so that a sanitary environment is not maintained within typical plastic sleeve pillowcase packaging.

Accordingly, a need exists for packaging which can contain a pillowcase, such as a silk pillowcase and/or a copper ion infused pillowcase, and which packaging can reveal with high fidelity an appearance of the pillowcase. Such packaging would beneficially also keep the pillowcase in a sanitary environment until used, to maximize benefits of the pillowcase, such as antibacterial benefits and other skin preserving benefits.

SUMMARY OF THE INVENTION

With this invention, packaging is provided for a pillowcase. In one embodiment, the pillowcase is made at least partially of silk. In another embodiment, the pillowcase is infused with copper ions. As an option, the pillowcase can be both made of silk and infused with copper ions. The pillowcase would generally have a shape and size similar to that of other prior art pillowcases. Thus, the pillowcase is a generally rectangular fabric structure, including a front panel and a rear panel joined together on three sides, and with a fourth side (typically a smaller one of the four sides) left open for inserting and removing a pillow.

The pillowcase is placed within packaging in the form of a glass jar. As one option, the glass jar is cylindrical in form with a cylindrical sidewall, a circular base and a circular rim surrounding an opening. The jar is preferably formed of a clear transparent glass. As an option, the glass could be colored and only translucent rather than fully transparent. The glass could be opaque as an option and colored, or left with natural coloration. Common glass-like alternatives could also be utilized.

The rim preferably includes male threads on an outer surface thereof. These threads can interconnect with female threads on a lip of a lid. While the lid could be transparent, most typically the lid is opaque. In one embodiment, the lid is black.

The pillowcase is folded and otherwise arranged to have a unique appearance through the sidewall of the jar (and typically also visible to some extent through the circular base of the jar). In particular, the pillowcase in one embodiment has at least portions that are of wrapped into a spiral form centered upon a vertical central axis, which is apparent when looking down through the opening of the jar after the pillowcase has been placed therein (and up through the base). The pillowcase includes folds, panels and edges which follow this spiral pattern. Light reflects off of these folds, panels and edges in a variety of different ways, so that a consumer can clearly see what the pillowcase fabric looks like, either when looking through the transparent side wall, or when looking down through the opening when the lid is removed from the jar. Similarly, the spiral form can be seen by looking up through the transparent circular base of the jar. With the fabric of the pillowcase directly adjacent to an inside of the cylindrical sidewall, attributes of the fabric forming the pillowcase can be readily discerned. Thus, for instance, a consumer can readily see that a high quality silk fabric was utilized to form the pillowcase and/or can see that the fabric has been infused with copper ions. Folding and arranging options other than spiral in form can alternatively be utilized.

The sidewall of the jar preferably has a constant thickness between an interior surface and an exterior surface. Also, the pillowcase is directly adjacent to the interior surface. With such a constant thickness and pillowcase positioning, distortion of light transmitted through the glass sidewall is kept to a minimum, so that a consumer can accurately discern the appearance of the pillowcase when viewing the pillowcase through the sidewall.

The jar in one embodiment has a basic cylindrical shape similar to that in which night cream and other skincare compositions are often contained. Night cream is a substance which is used to soothe and calm the skin as you sleep, reducing any redness and irritation over night. By supporting the skin's natural regenerative processes while you're sleeping, these creams help to give you a more consistent complexion when you wake up. Night cream also keeps the skin hydrated.

At least some of the benefits of use of night cream are related to the benefits associated with use of a silk pillowcase and/or a copper ion infused fabric pillowcase. Thus, packaging the silk and/or copper ion infused pillowcase in a jar which is similar to that in which night creams and other skincare compositions are commonly merchandised, creates a practical association for the consumer. Communication about the benefits of use of the pillowcase can to some extent be caused to occur merely by encountering the shape (and also the glass material) of the jar, indicative that the pillowcase will have some beneficial attributes similar to those associated with using night cream and/or various skincare compositions. Furthermore, the unconventional packaging of a pillowcase within a transparent glass jar helps the pillowcase to stand out from other pillowcases which do not have skin supporting attributes. Creating such a visual and mental association between the product, and the consumer through use of the jar packaging is both beneficial for the consumer and providers of the pillowcase, including retailers and/or wholesalers or other vendors.

Typically, information would also be printed either directly onto the sidewall of the jar or onto a label affixed to the sidewall (and/or the lid and/or base). Such information printed on the jar can also be supportive of the process of explaining to consumers the attributes and benefits of the pillowcase contained within the jar.

OBJECTS OF THE INVENTION

Accordingly, a primary object of the present invention is to contain a pillowcase, such as during retailing thereof to consumers.

Another object of the present invention is to provide packaging to contain a pillowcase in a manner which allows for the pillowcase to be accurately seen and inspected while remaining inside of the packaging.

Another object of the present invention is to provide ajar for holding a pillowcase therein.

Another object of the present invention is to provide ajar and lid which can hold a pillowcase.

Another object of the present invention is to provide a pillowcase and jar combination which causes an association to occur between attributes of the pillowcase and attributes of night cream and/or other skincare compositions.

Another object of the present invention is to provide ajar which provides a sanitary environment for a pillowcase contained therein.

Other further objects of the present invention will become apparent from a careful reading of the included drawing figures, the claims and detailed description of the invention.

BRIEF DESCRIPTION OF THE DRAWINGS

FIG. 9 is a perspective view of an alternative embodiment jar having different proportions than those of the jar of FIG. 1.

FIG. 10 is a front elevation view of that which is shown in FIG. 9.

FIG. 11 is a left side elevation view of that which is shown in FIG. 9.

FIG. 12 is a right side elevation view of that which is shown in FIG. 9.

FIG. 13 is a rear elevation view of that which is shown in FIG. 9.

FIG. 14 is a top plan view of that which is shown in FIG. 9.

FIG. 15 is a bottom plan view of that which is shown in FIG. 9.

DESCRIPTION OF THE PREFERRED EMBODIMENT

Figure 1:
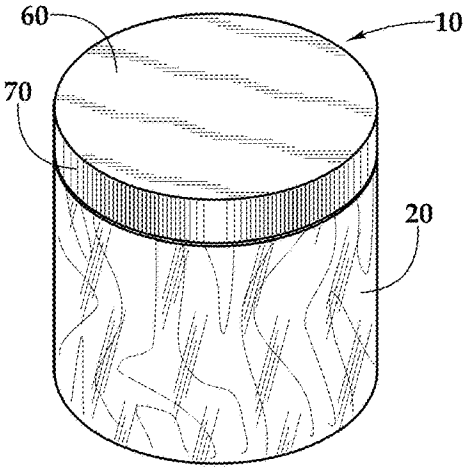
FIG. 1 is a perspective view of a jar according to a first embodiment with a pillowcase contained therein, the pillowcase visible through a transparent sidewall of the jar.
Figure 2:
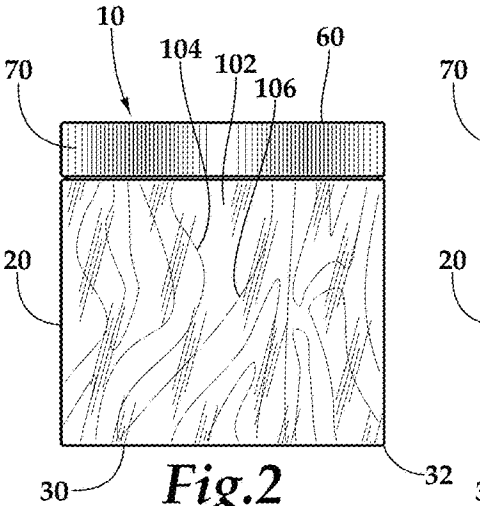
FIG. 2 is a front elevation view of that which is shown in FIG. 1.
Figure 3:
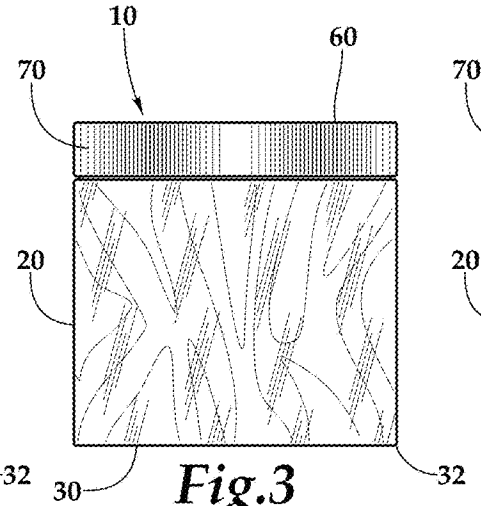
FIG. 3 is a left side elevation view of that which is shown in FIG. 1.
Figure 4:
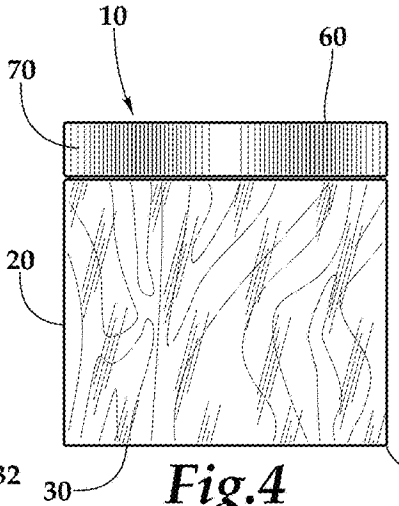
FIG. 4 is a right side elevation view of that which is shown in FIG. 1.
Figure 5:
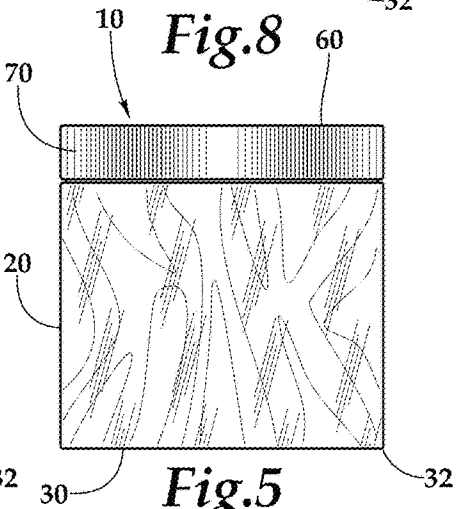
FIG. 5 is a rear elevation view of that which is shown in FIG. 1.
Figure 6:
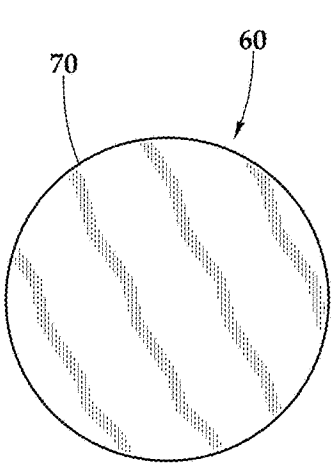
FIG. 6 is a top plan view of that which is shown in FIG. 1.
Figure 7:
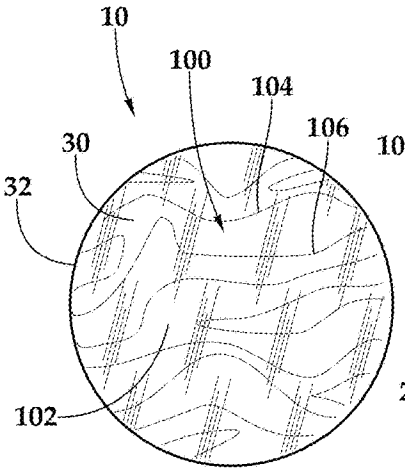
FIG. 7 is a bottom plan view of that which is shown in FIG. 1.
Figure 8:
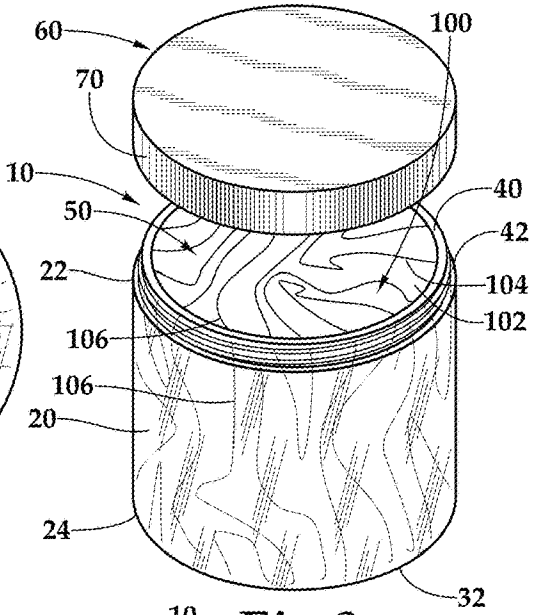
FIG. 8 is a perspective exploded view of that which is shown in FIG. 1, with a lid portion of the jar exploded away from a remainder of the jar.

Referring to the drawings, wherein like reference numerals represent like parts throughout the various drawing figures, reference numeral 10 is directed to a jar, which contains a pillowcase 100 therein. While the pillowcase 100 could be any type of pillowcase, in certain embodiments the pillowcase 100 is formed of silk and/or is infused with copper ions and in various embodiments exhibits particular fold patterns.

In essence, and with particular reference to FIGS. 1, 8 and 16-19, basic details of the jar 10 and included pillowcase 100 are described, according to one example embodiment. In this embodiment, the jar 10 includes a cylindrical sidewall 20 extending up from the base 30 to a rim 40 surrounding an opening 50. A lid 60 can close off the opening 50, with the lid 60 including a lip 70 configured to engage with the rim 40. A pillowcase 100 is placed within the jar 10. The sidewall 20 is at least partially transparent so that the pillowcase 100 can be seen through the sidewall 20 of the jar 10.

More specifically, and with particular reference to FIGS. 1-8 and 16-19, details of the jar 10 are described, according to one example embodiment. The jar 10 in this embodiment is generally cylindrical in form with a cylindrical sidewall 20 extending up from the circular base 30. As an alternative, the jar 10 could have faceted sides and a polygonal base, or could be some other shape.

In this example embodiment, the sidewall 20 is cylindrical in form and extends from a lower edge 24 adjacent to the base 30 up to an upper edge 22 opposite the lower edge 24. The edges 22, 24 are preferably circular in form and parallel with each other, so that the cylindrical sidewall 20 has a uniform height when the base 30 is oriented within a horizontal plane. The upper edge 22 also defines a rim 40 for the jar 10.

The base 30 is circular in form and bordered by a perimeter edge 32. This perimeter edge 32 is circular in form and generally co-extensive with the lower edge 24 of the cylindrical sidewall 20. In one embodiment, a corner defined by the lower edge 24 of the cylindrical sidewall 20 and the perimeter edge 32 of the base 30 is rounded somewhat, rather than sharp. A foot structure can be provided inboard of the perimeter edge 32 of the base 30 in at least one embodiment. Such a foot structure could be an annular rib which extends circumferentially inboard of the perimeter edge 32 of the base 30, or could be a series of discrete structures that extend down from the base 30 and allow the jar 10 to abut a surface, such as a countertop or tabletop, or other horizontal surface.

The rim 40 preferably includes male threads 42 on an outer surface thereof. These threads 42 can interact with female threads on an inside of a lip 70 extending down from a perimeter of the lid 60. These threads engage together to allow for the lid 60 to be securely but removably attached to the rim 40 of the jar 10.

In one embodiment, a tamper evident seal is provided over the lip 60 and rim 40 of the jar 10. This seal is typically continuous in form and must be broken before the lip 60 can be removed from the jar 10. Such a tamper evident seal allows for an interior of the jar 10 to be sanitized before placement of the pillowcase 100 therein. The pillowcase 100 is thus able to be kept in a sanitized environment when contained within the jar 10, and a consumer can inspect the seal, and if intact, have confidence that sanitation has been maintained. While such seals are common for food and pharmaceutical packaging, such seals are unique for textile goods and further reinforce to consumers attributes of the goods.

The jar 10 is preferably formed of glass. The glass forming the jar 10 is preferably at least partially transparent, and most preferably substantially entirely transparent. In this way, the pillowcase 100 can be inspected through a transparent cylindrical sidewall 20 (or base 30), before purchasing or otherwise selecting the pillowcase 100 and jar 10. The jar 10 could alternatively be made from a glass substitute, either currently known or developed in the future.

With continuing reference to FIGS. 7, 8 and 16-19, details of the pillowcase 100 are described according to an example embodiment. The pillowcase 100 is formed of separate panels 102, such as a front panel and rear panel, which are joined together at edges thereof, leaving one portion of a perimeter of the panels open to allow for a pillow to be placed within the pillowcase 100. Typically the panels 102 are similar in size and shape and typically rectangular with one of the short sides being the open side. The panels can appear to be separate, but actually formed together as a single sheet and then folded at one edge thereof, and still generally be considered to have two panels 102. The pillowcase 100 is folded so that the pillowcase 100 exhibits folds 104. The folded pillowcase 100 is placed within the opening 50 and down into the jar 10.

Figure 16:
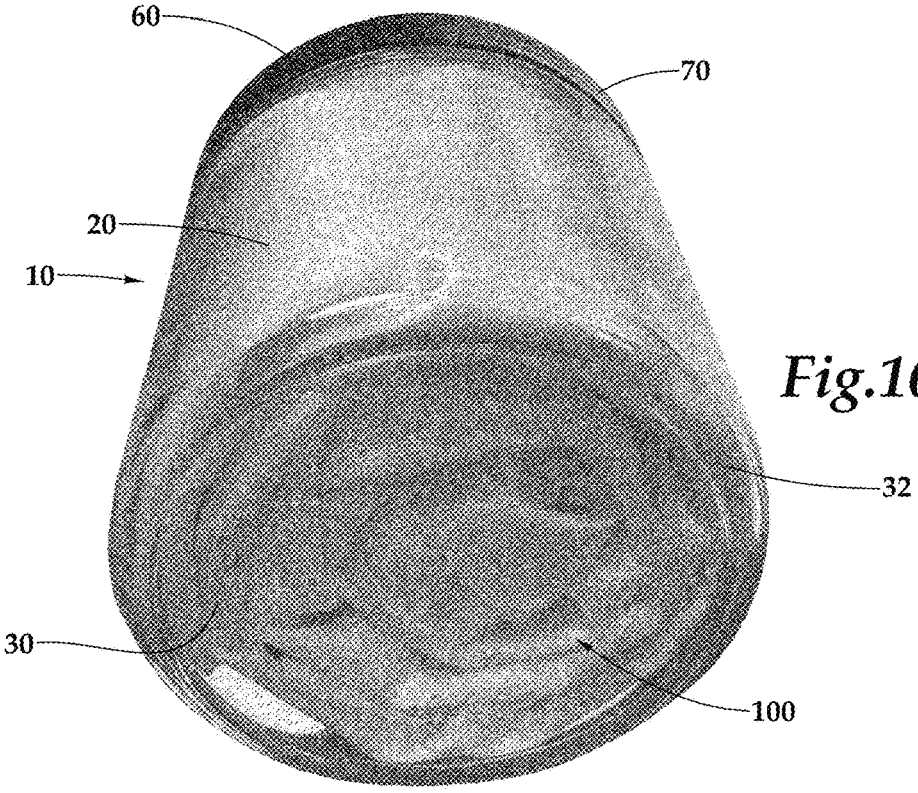
FIG. 16 is a perspective view from below of that which is shown in FIG. 1, generally in the nature of a photograph of one embodiment of the invention, and with the lid on the jar.
Figure 17:
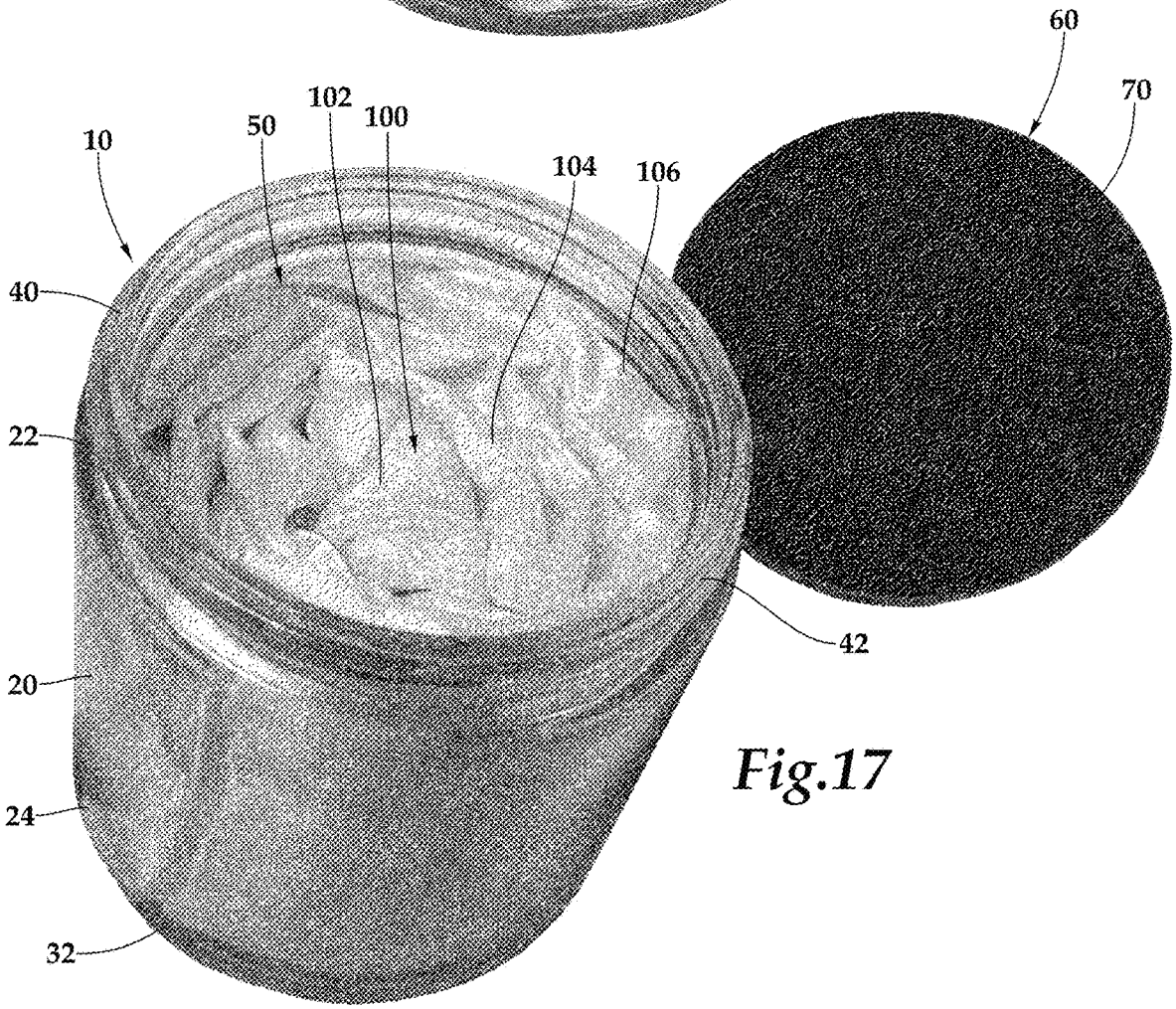
FIG. 17 is a perspective view from above of that which is shown in FIG. 16, and with the lid off of the jar, with a pillowcase seen in a spiral configuration inside of the jar.
Figure 18:
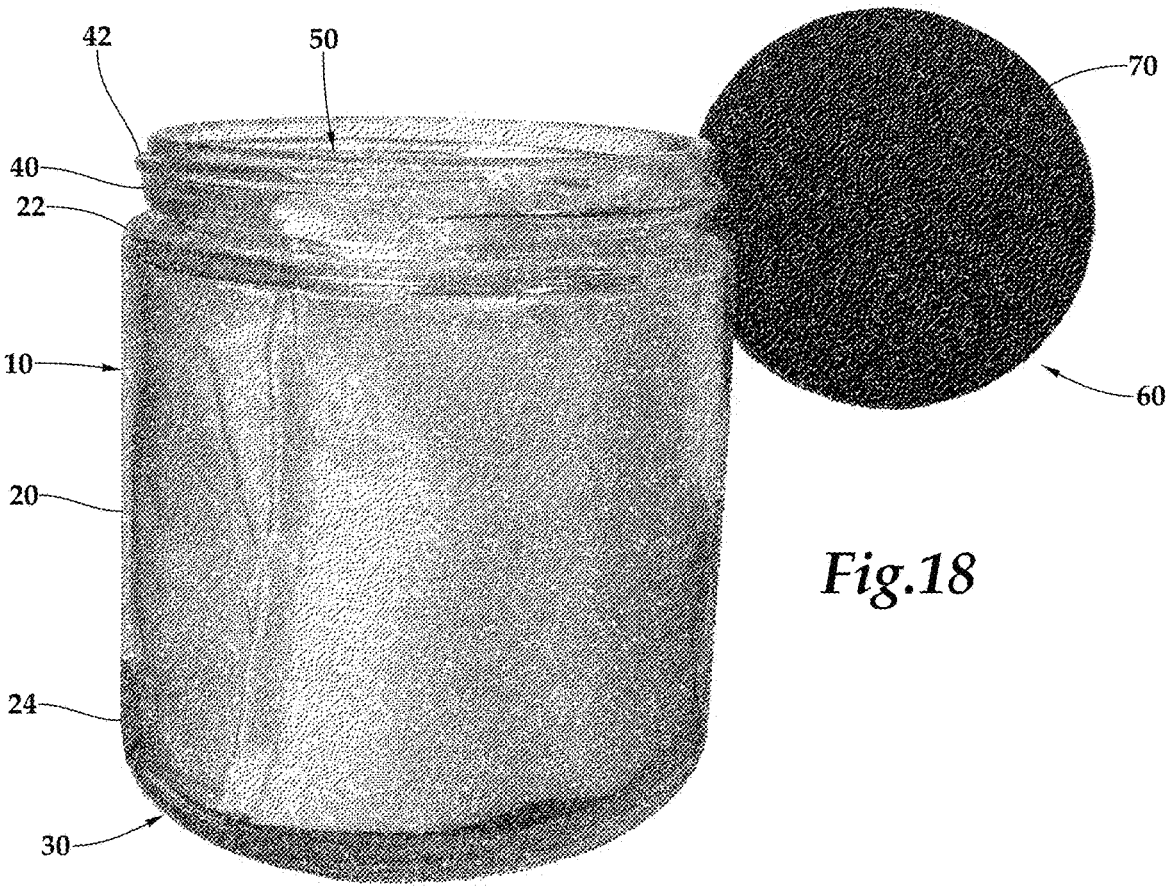
FIG. 18 is a front perspective view of that which is shown in FIG. 16, and with the lid off of the jar.
Figure 19:
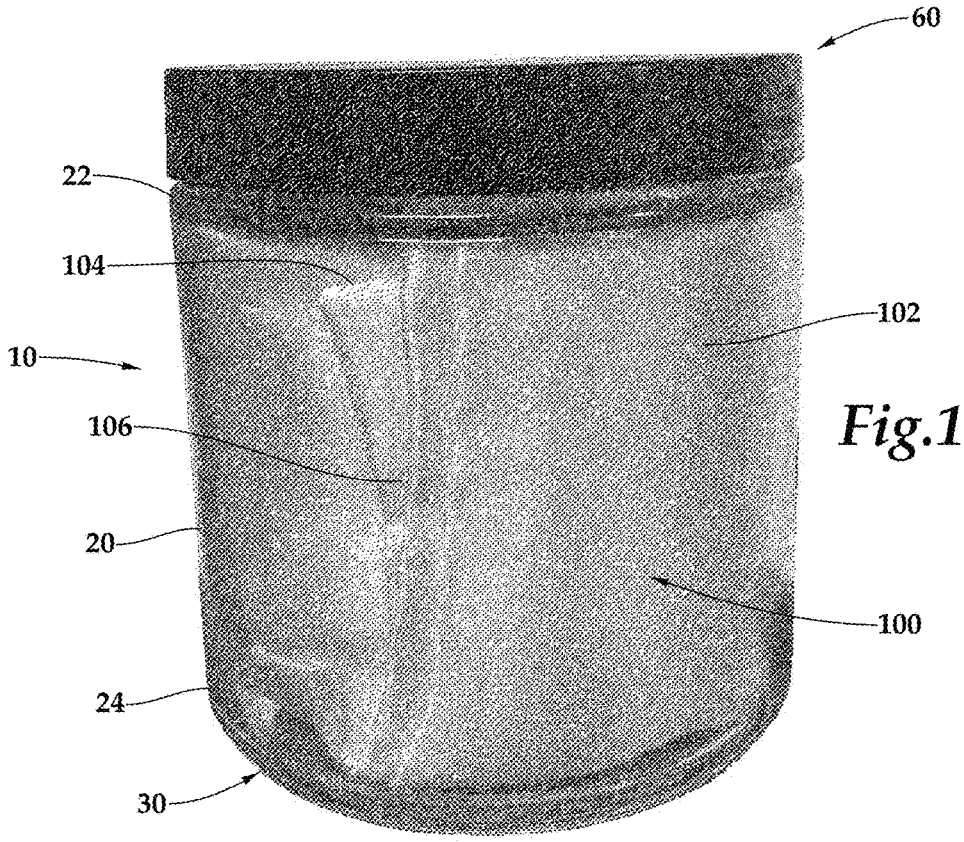
FIG. 19 is a front perspective view of that which is shown in FIG. 16, and with the lid on the jar.

At least panels 102 and folds 104 can be viewed through the sidewall 20 and/or base 30 of the jar 10 with edges 106 also typically seen as well. Such viewing and inspection allows a user to verify quality and other attributes of the pillowcase 100, such as before making a purchase. In one embodiment, the pillowcase 100 is formed of silk. In one embodiment, the pillowcase 100 is infused with copper ions. In one embodiment, the copper ions are visible to a user through the sidewall 20 of the jar 10. FIGS. 16-18 show one particular spiral pattern by which the pillowcase 100 can be folded. In one embodiment, the particular pattern is an attribute of this invention. In other embodiments, the invention is not limited to the particular pattern shown, but to the concept of seeing the pillowcase 100 through a wall of the jar 10 as a general concept.

The jar 10 has a general shape similar to that which is often used for containing night cream and/or skincare compositions. Night cream is known to have beneficial attributes for skin of users. In a similar manner, silk pillowcases 100 and/or copper ion infused pillowcases have beneficial attributes for skin of a user of the pillowcase 100. By placing the pillowcase 100 within such a jar as the jar 10, a reinforcing correlation is provided for the consumer between the shape of the jar 10, and the function of the pillowcase 100, both being for care of skin for instance.

In one embodiment, the pillowcase 100 is rolled into a spiral form, so that the pillowcase 100 is somewhat cylindrical in shape before being inserted through the opening 50 and into an interior of the jar 10. In such a configuration (see FIG. 17) the spiral of the pillowcase 100 can be seen when the lid is removed. Similarly, this spiral can be seen when looking up through the base 30, should the base 30 also be formed of transparent glass material along with a cylindrical sidewall 20 of the jar 10.

With particular reference to FIGS. 9-15, details of an alternative embodiment short jar 110 are described. The short jar 110 can be provided for a smaller pillowcase 100, or when a different geometry is desired for the jar 110. The small jar 110 includes a cylindrical sidewall 120 extending up from a circular base 130. A perimeter edge 132 defines a diameter of the circular base 130. A rim 140 is located on a portion of the cylindrical sidewall 120 opposite the perimeter edge 132 of the base 130.

A lid 160 attaches to the rim 140 of the short jar 110. A lip 170 is provided on the lid 160 to facilitate rim 140 attachment. As with the jar 10 of FIGS. 1-8, the short jar 110 is preferably formed of transparent glass so that the pillowcase 100 contained therein can be seen through the cylindrical sidewall 120 and also through the circular base 130 of the short jar 110.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified.

What is claimed is:

1. A method for packaging a pillowcase, the method include the steps of:

placing a pillowcase within a jar, the jar having a base and a sidewall extending up from the base to a rim;

closing the rim of the jar by placing a lid over the rim;

wherein the jar is substantially transparent;

allowing the pillowcase to be viewed through a wall of the jar by individuals, including consumers of the goods;

wherein the pillowcase has at least panels and folds visible through the wall of the jar during said allowing step;

wherein the jar is cylindrical in form;

wherein the jar includes a circular base and a cylindrical sidewall extending up from the base to a circular rim;

wherein threads are provided upon the circular rim, and the lid includes a lip with threads thereon which are complementary with the threads on the circular rim;

wherein the pillowcase is a silk pillowcase;

wherein the pillowcase is infused with copper ions;

the pillowcase including:

a front panel;

a rear panel; and the front panel and the rear panel each formed of flexible silk fabric;

the front panel and the rear panel joined together on at least portions of edges thereof to surround an enclosure for a pillow; and after said placing step creating a visually apparent reinforcing correlation between the shape of the jar—which has a shape related to that which is often used to contain night cream and/or skincare compositions—and a purpose of the silk and copper ion infused pillowcase—having beneficial attributions for skin.

2. The method of claim 1 including the further step of sealing the lid to the rim.

3. The method of claim 2 including the first step of sealing the lid to the rim with a tamper evident seal.

* * * * *